US008388773B2

(12) United States Patent
Luntz et al.

(10) Patent No.: US 8,388,773 B2
(45) Date of Patent: Mar. 5, 2013

(54) APPARATUS FOR AND METHOD OF CONDITIONING SHAPE MEMORY ALLOY WIRE

(75) Inventors: Jonathan E. Luntz, Ann Arbor, MI (US); John Andrew Shaw, Dexter, MI (US); Diann Brei, Milford, MI (US); Christopher Burton Churchill, Ann Arbor, MI (US); Anupam Pathak, Ann Arbor, MI (US); Nilesh D. Mankame, Ann Arbor, MI (US); Alan L. Browne, Grosse Pointe, MI (US); Nancy L. Johnson, Northville, MI (US); Paul W. Alexander, Ypsilanti, MI (US); Xiujie Gao, Troy, MI (US); Pablo D. Zavattieri, Ann Arbor, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 218 days.

(21) Appl. No.: 12/400,500

(22) Filed: Mar. 9, 2009

(65) Prior Publication Data

US 2009/0223604 A1 Sep. 10, 2009

Related U.S. Application Data

(60) Provisional application No. 61/034,840, filed on Mar. 7, 2008.

(51) Int. Cl.

| | |
|---|---|
| ***C22F 1/00*** | (2006.01) |
| *C21D 11/00* | (2006.01) |
| *C21D 1/54* | (2006.01) |
| *C21D 1/55* | (2006.01) |

(52) U.S. Cl. ..... 148/563; 148/500; 148/508

(58) Field of Classification Search ..... 148/500, 148/508, 563

See application file for complete search history.

(56) References Cited

U.S. PATENT DOCUMENTS 3,948,688 A * 4/1976 Clark ..... 148/563

* cited by examiner

*Primary Examiner* — Jessica L. Ward
*Assistant Examiner* — Alexander Polyansky

(57) ABSTRACT

An apparatus for and method of conditioning a thermally activated shape memory alloy wire for use in an application, wherein the apparatus includes an adjustable hard-stop and the preferred method includes pre-determining a minimum activating current, allowable strain, and a loading magnitude and form based on the wire configuration and application, and further includes applying a double-exponential model to determine a final recoverable strain over fewer cycles.

10 Claims, 3 Drawing Sheets

APPARATUS FOR AND METHOD OF CONDITIONING SHAPE MEMORY ALLOY WIRE

RELATED APPLICATIONS

This patent application claims priority to, and benefit from U.S. Provisional Patent Application Ser. No. 61/034,840, entitled "PROTOCOL FOR CONDITIONING AN ACTIVE MATERIAL ELEMENT UTILZING LOAD HISTORY," filed on Mar. 7, 2008.

BACKGROUND OF THE INVENTION

1. Field of the Invention

The present disclosure generally relates to methods of conditioning (i.e., "shaking down") a shape memory alloy wire for predictable use as an actuator; and more particularly, to an improved apparatus, method and model for conditioning shape memory alloy wires.

2. Discussion of Prior Art

Shape memory alloy is used increasingly in place of traditional actuators because of their compactness, high work density, low cost, ruggedness, high force generation, and relatively large strains. One well known concern in the art associated with SMA wires, however, is degradation in performance as actuation cycles accumulate. Significant reductions have been observed as soon as only tens or hundreds of cycles. Thus, to insure stable long-term performance, manufacturers typically recommend very conservative limits on the suggested maximum operational force, ensuring minimal losses in actuator stroke at the cost of reduced overall performance and efficiency. For example, it is appreciated that the maximum load for one class of 15 mil, 70° C. wire is specified at 20 N, which is low considering that actuation motion for the wire can still be obtained for loads above 80 N.

It is also known in the art to shake down shape memory alloy wire prior to use as an actuator by running the specimen through a plurality of thermally induced activation cycles until the recovered strain stabilizes. Concernedly, however, conventional shakedowns typically present one-size-fits-all protocols that do not take into consideration many aspects of the proposed application. As such, wire performance and/or fatigue life is often inefficiently and unnecessarily reduced.

BRIEF SUMMARY OF THE INVENTION

This invention concerns an improved apparatus for and method of conditioning or "shaking down" a SMA wire under specified conditions tailored to the proposed application. The invention is useful, among other things, for enabling the wire to achieve a more stable post-shakedown performance and produces actuators that more efficiently realize the high force potential of the SMA material. The invention is further useful for increasing the efficiency of the shake-down process by providing a means for reducing the number of cycles necessary to determine a stable performance measure, and the minimum required current used per cycle.

In one aspect of the invention, a method of performing a shakedown of SMA wire is presented, wherein the wire is thermally cycled under electrical heating and performance is predicted by a double-exponential empirical model. The model fits the inchoate data, so as to capture the steady state performance of the wire and the rate at which shakedown occurs.

More particularly, the method includes applying a load to, so as to produce tension in, the wire, determining a minimum current sufficient to completely transform the wire from the Martensitic phase to the Austenitic phase when the wire is under load, and setting a hard-stop at a location, so as to limit strain in the wire. Next, the current is repetitively applied to the wire over a plurality of cycles, such that the wire heats to fully transform from the Martensitic and to the Austenitic phase, and then cools to fully transform back to the Martensitic phase. The steady-state wire strain when in the fully Martensitic and Austenitic phases are plotted for each cycle, and a final recoverable Austenitic strain is determined.

The disclosure may be understood more readily by reference to the following detailed description of the various features of the disclosure and the examples included therein.

BRIEF DESCRIPTION OF THE SEVERAL VIEWS OF THE DRAWING

A preferred embodiment(s) of the invention is described in detail below with reference to the attached drawing figures of exemplary scale, wherein.

DETAILED DESCRIPTION OF THE INVENTION

Figure 1:
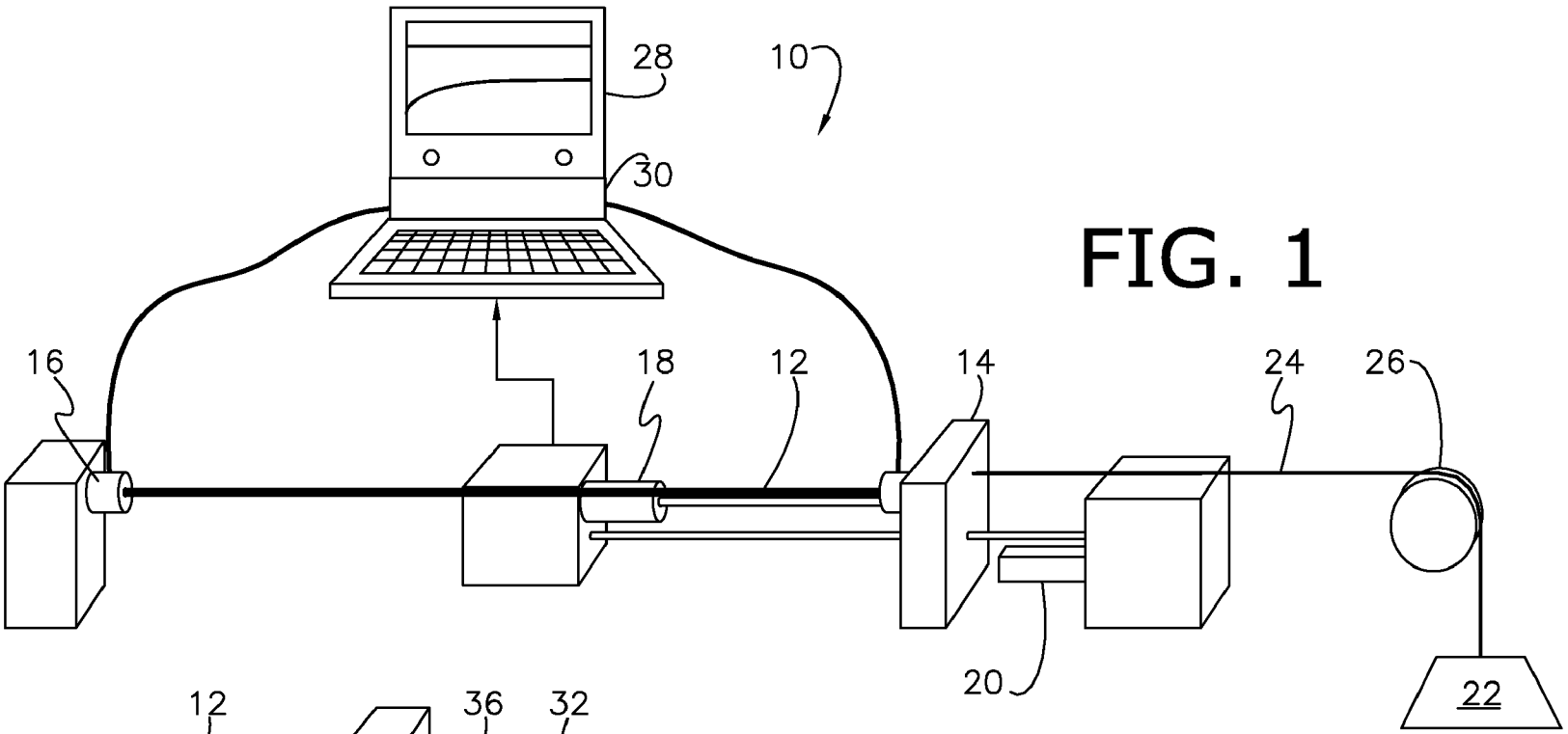
FIG. 1 is an elevation of an apparatus configured to condition a shape memory alloy wire, including a translatable slider, adjustable hard-stop, and dead weight, in accordance with a preferred embodiment of the invention.

In general, this invention concerns a novel apparatus (e.g., test rig, or "set-up") 10 for, method of, and model used in the shakedown or otherwise conditioning of shape memory alloy wire 12 prior to use as an actuator. In a first aspect of the invention, there is disclosed an improved experimental apparatus 10 for use in performing variable shakedown of shape memory alloy wire 12 (FIG. 1); in a second aspect, the apparatus 10 is used to perform an improved method of conditioning the wire 12; and in a third aspect, a model is proposed for predicting and streamlining the shakedown procedure. The following description of the preferred embodiments is merely exemplary in nature and is in no way intended to limit the invention, its application, or uses. For example, as used herein the term "wire" is non-limiting, and encompasses other equivalent geometric configurations such as bundles, loops, braids, cables, ropes, chains, strips, etc.

I. Shape Memory Alloy Material Discussion and Functionality

Shape memory alloy is an "active material," and as such, is understood by those of ordinary skill in the art, to exhibit a reversible change in a fundamental (e.g., chemical or intrinsic physical) property, when exposed to or occluded from an activation signal. It is appreciated that this type of active material has the ability to rapidly displace, or remember its original shape and/or elastic modulus, which can subsequently be recalled by applying an external stimulus.

More particularly, SMA's generally refer to a group of metallic materials that demonstrate the ability to return to some previously defined shape or size when subjected to an appropriate thermal stimulus. Shape memory alloys are capable of undergoing phase transitions in which their yield strength, stiffness, dimension and/or shape are altered as a function of temperature. The term "yield strength" refers to the stress at which a material exhibits a specified deviation from proportionality of stress and strain.

Generally, in the low temperature, or Martensite (diffusionless) phase, shape memory alloys exists in a low symmetry monoclinic B19' structure with twelve energetically equivalent lattice correspondence variants that can be pseudo-plastically deformed. Upon exposure to some higher temperature it will transform to an Austenite or parent phase, which has a B2 (cubic) crystal structure. Transformation returns the alloy element to its shape prior to the deformation. Materials that exhibit this shape memory effect only upon heating are referred to as having one-way shape memory. Those materials that also exhibit shape memory upon re-cooling are referred to as having two-way shape memory behavior.

In the following discussion, the Martensite phase generally refers to the more deformable, lower temperature phase whereas the Austenite phase generally refers to the more rigid, higher temperature phase. When the shape memory alloy is in the Martensite phase and is heated, it begins to change into the Austenite phase. The temperature at which this phenomenon starts is often referred to as Austenite start temperature ($A_s$). The temperature at which this phenomenon is complete is called the Austenite finish temperature ($A_f$).

When the shape memory alloy is in the Austenite phase and is cooled, it begins to change into the Martensite phase, and the temperature at which this phenomenon starts is referred to as the Martensite start temperature ($M_s$). The temperature at which Austenite finishes transforming to Martensite is called the Martensite finish temperature ($M_f$). Generally, the shape memory alloys are softer and more easily deformable in their Martensitic phase and are harder, stiffer, and/or more rigid in the Austenitic phase. In view of the foregoing, a suitable activation signal for use with shape memory alloys is a thermal activation signal having a magnitude to cause transformations between the Martensite and Austenite phases.

As previously mentioned, shape memory alloys can exhibit a one-way shape memory effect, an intrinsic two-way effect, or an extrinsic two-way shape memory effect depending on the alloy composition and processing history. Annealed shape memory alloys typically only exhibit the one-way shape memory effect. Sufficient heating subsequent to low-temperature deformation of the shape memory material will induce the Martensite to Austenite type transition, and the material will recover the original, annealed shape. Hence, one-way shape memory effects are only observed upon heating. Active materials comprising shape memory alloy compositions that exhibit one-way memory effects do not automatically reform, and will likely require an external mechanical force if it is judged that there is a need to reset the device.

Intrinsic and extrinsic two-way shape memory materials are characterized by a shape transition both upon heating from the Martensite phase to the Austenite phase, as well as an additional shape transition upon cooling from the Austenite phase back to the Martensite phase. Active materials that exhibit an intrinsic shape memory effect are fabricated from a shape memory alloy composition that will cause the active materials to automatically reform themselves as a result of the above noted phase transformations. Intrinsic two-way shape memory behavior must be induced in the shape memory material through processing. Such procedures include extreme deformation of the material while in the Martensite phase, heating-cooling under constraint or load, or surface modification such as laser annealing, polishing, or shot-peening. Once the material has been trained to exhibit the two-way shape memory effect, the shape change between the low and high temperature states is generally reversible and persists through a high number of thermal cycles. In contrast, active materials that exhibit the extrinsic two-way shape memory effects are composite or multi-component materials that combine a shape memory alloy composition that exhibits a one-way effect with another element that provides a restoring force to reform the original shape.

The temperature at which the shape memory alloy remembers its high temperature form when heated can be adjusted by slight changes in the composition of the alloy and through heat treatment. In nickel-titanium shape memory alloys, for instance, it can be changed from above about 100° C. to below about −100° C. The shape recovery process occurs over a range of just a few degrees and the start or finish of the transformation can be controlled to within a degree or two depending on the desired application and alloy composition. The mechanical properties of the shape memory alloy vary greatly over the temperature range spanning their transformation, typically providing the system with shape memory effects, superelastic effects, and high damping capacity.

Suitable shape memory alloy materials include, without limitation, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-platinum based alloys, iron-palladium based alloys, and the like. The alloys can be binary, ternary, or any higher order so long as the alloy composition exhibits a shape memory effect, e.g., change in shape orientation, damping capacity, and the like.

It is appreciated that SMA's exhibit a modulus increase of 2.5 times and a dimensional change (recovery of pseudo-plastic deformation induced when in the Martensitic phase) of up to 8% (depending on the amount of pre-strain) when heated above their Martensite to Austenite phase transition temperature. It is appreciated that thermally induced SMA phase changes are one-way so that a biasing force return mechanism (such as a spring) would be required to return the SMA to its starting configuration once the applied field is removed. Joule heating can be used to make the entire system electronically controllable.

Stress induced phase changes in SMA, caused by loading and unloading of SMA (when at temperatures above $A_f$), are two way by nature. That is to say, application of sufficient stress when an SMA is in its Austenitic phase will cause it to change to its lower modulus Martensitic phase in which it can exhibit up to 8% of "superelastic" deformation. Removal of the applied stress will cause the SMA to switch back to its Austenitic phase in so doing recovering its starting shape and higher modulus.

Ferromagnetic SMA's (FSMA's) are a sub-class of SMAs. These materials behave like conventional SMA materials that have a stress or thermally induced phase transformation between Martensite and Austenite. Additionally FSMA's are ferromagnetic and have strong magnetocrystalline anisotropy, which permit an external magnetic field to influence the orientation/fraction of field aligned Martensitic variants. When the magnetic field is removed, the material may exhibit complete two-way, partial two-way or one-way shape memory. For partial or one-way shape memory, an external stimulus, temperature, magnetic field or stress may permit the material to return to its starting state. Perfect two-way shape memory may be used for proportional control with continuous power supplied. One-way shape memory is most useful for rail filling applications. External magnetic fields are generally produced via soft-magnetic core electromagnets in automotive applications, though a pair of Helmholtz coils may also be used for fast response.

II. SMA Conditioning Apparatus: Description and Use

Turning to the configuration of the present invention, it is appreciated that the motion loss during shakedown is highly dependent on the loading and strain history experienced by the wire 12 during cycling (level, form, etc.). That is to say, the allowed strain, and the form (e.g., spring, constant, etc.) and magnitude of the loading function used during the shakedown contribute to determine the motion loss attributable to shakedown. As such, the present shakedown method takes into account and tailors the magnitude of the applied load, the allowed strain, and the load form to produce a desired outcome.

In FIG. 1, the apparatus 10 for performing the shakedown is exemplarily shown. The apparatus 10 is capable of electrically heating a length of SMA wire, while applying a load thereto, and measuring the tensile load and strain or displacement resulting therefrom. As such, the apparatus 10 includes securing fixtures for retaining the wire 12 in a fixed position, wherein the first and/or second ends is free to displace, so as to allow the wire 12 to strain. In the illustrated embodiment, one of the ends is securely coupled to a translatable slider 14.

The illustrated setup 10 further consists of a suitable (e.g., Cooper Instruments DFI 2555) force transducer 16 to measure the load applied to the SMA wire, and a suitable (e.g., LVDT Omega LDX-3A) displacement transducer 18 to measure its displacement. The wire 12 is attached to the displacement transducer 18 and slider 14, for example, with set screw crimps. The inventive shakedown apparatus further includes an adjustable hard-stop 20 that prevents the slider 14 from moving past a set point and limits the amount of strain that the wire 12 can undergo. The applied load may be a hanging mass 22, the weight of which is transmitted to the slider 14 through a low-friction string 24 and pulley 26. The force and displacement data are fed through a suitable (e.g., National Instruments NI USB-6009) data acquisition card/controller 28 and recorded through suitable software (e.g., LabView). A current is applied to the wire 12 using a suitable (Kepco ATE 55-20DMG) power supply 30 that is programmed to output desired currents and voltages.

It is appreciated that because Austenite transition temperatures vary with stress, the required heating current is a function of the applied load, wire type and diameter, and must be determined separately for each shakedown process. Thus, prior to shaking down the wire 12, the level of electrical current which fully heats the wire 12 to its Austenitic phase under a given load without overheating is determined. Once the predetermined current is applied to the wire 12, the hard-stop location is measured from the Austenite length, and set to limit the strain to a desired maximum. The hard-stop 20 may be positioned and configured to function as a Martensitic or Austenitic hard-stop 20, and may be gradually or incrementally adjustable.

More particularly, to determine the required heating current, the wire 12 is inserted in the apparatus 10, input current is increased incrementally, and the force-deflection curve at each level is generated. This is accomplished by manually holding the hanging mass 22 and slowly allowing its weight to transfer to the wire 12, gradually increasing its tension, under a given current. The mass 22 is then gradually lifted off the wire 12 decreasing the tension back to zero. The resulting cyclic force-deflection curve depends on the level of current, where, as the current is increased, the wire 12 becomes progressively stiffer until a full transition to Austenite is obtained. For example, it is appreciated that for a 0.015" diameter, 70° C. SMA wire with a maximum 75 N load, a 0.75 A current does not fully transform the wire to Austenite and results in a low load-displacement hysteresis loop, whereas a 1.25 A current is sufficient to fully transform the wire 12 at loads up to 75 N. As determined through further observation, lighter loads require less current while larger loads require more.

To prevent overstraining the wire 12 during shakedown, the inventive hard-stop 20 limits its motion. This allows larger loads to be used that can be supported by the wire 12 in the Austenitic phase but would otherwise damage the wire 12 when Martensitic. Given a desired maximum allowable strain, the hard-stop location is determined by first heating the wire 12 until it is fully Austenitic, and while under no load, measuring the resulting Austenite Free Length (AFL). The strain is referenced as a percent increase relative to the AFL, and the hard-stop 20 is set to block the motion of the slider 14 when this strain is reached.

Figure 2:
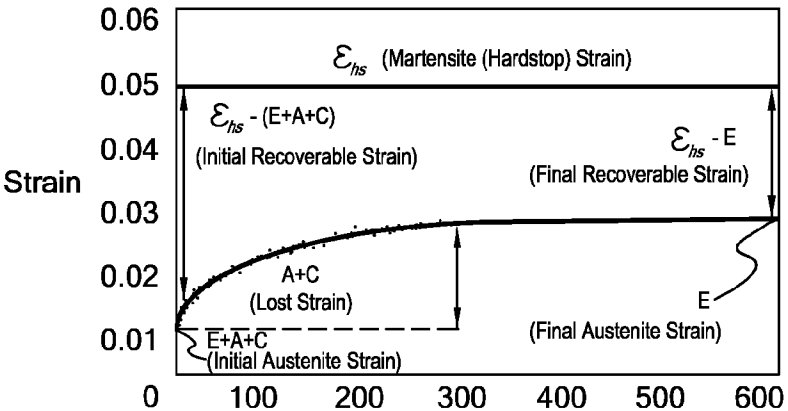
FIG. 2 is a schematic representation of a sampling of Martensitic and Austenitic strain points plotted and fitted to a double-exponential model, in accordance with a preferred embodiment of the invention.

Once the preferred current level, hard-stop location, and load are determined, shakedown is performed by cyclically applying the current with the hard-stop 20 and load 22 in place. Initially, when the wire 12 is cool, the load 22 stretches the Martensitic wire 12 until the hard-stop 20 is reached, resulting in the Martensitic hard-stop strain (FIG. 2). When heated, the wire 12 transforms to the Austenitic phase and contracts, thereby lifting the weight off the hard-stop and to a position determined by the capabilities of the wire 12 (FIG. 2), or, where provided, by an Austenitic hard-stop. Sufficient time for the SMA wire to fully heat and cool, such that the motion in each direction reaches a steady state value, is provided; and the cycle is repeated.

As the wire undergoes many heating-cooling cycles, the steady-state strain in both the Austenite and Martensite phases are plotted, for example, as shown for the 48 N, 4.9% hard-stop strain sample of FIG. 2. Since the load 22 pulls the wire 12 against the hard-stop 20 at every cycle, the Martensite curve is horizontal. The Austenite phase lifts the load 22 a large amount in the initial cycles, but the total motion decays gradually over hundreds of cycles, stabilizing to a steady-state value where the performance generally no longer varies with cycles. In the example reflected in FIG. 2, the initial Austenite strain is approximately 1%, which represents a net 3.9% initial recoverable strain relative to the 4.9% hard-stop strain. As shown, the Austenite strain decays after approximately 600 cycles to a steady-state value of 2.2%, resulting in a loss of 1.2% recoverable strain. This net 3.7% recoverable strain after shakedown represents the stable attainable performance from the wire at a 48 N load and is the appropriate value to use for stable actuator stroke.

In an inventive aspect, the plotted data (FIG. 2) is used to develop an empirical model of the system that relates the shakedown performance to the loading conditions. That is to say, the model captures the salient features of the shakedown process including the motion decay and steady-state performance of the Austenite strain. It is appreciated that a much lower number of cycles is needed to develop the model than is required to empirically achieve a stable Austenitic strain, wherein the critical number of cycles is based on the acceptable error rate of the model. The model can be used to extrapolate the curve out to the final recoverable strain, thereby enabling the wire 12 to safely continue its shake-down, while contemporaneously being used as an actuator. Moreover, it is appreciated that the model may be used, to run short duration cycling tests iteratively to determine the best load magnitude and type for cycling the wire and achieving the desired long-term behavior.

For example, and as further reflected in FIG. 2, a preferred model employs a double-exponential curve fit of the form:

$$\epsilon=-Ae^{x/B}-Ce^{x/D}+E \quad (1),$$

wherein x is the number of cycles, coefficients B and D are decay rate constants with units of cycles, and coefficients A and C describe the amount of strain lost at each decay rate. It is appreciated that the first two terms of equation (1) approach zero as x goes to infinity, leaving coefficient E as the final value of the Austenite strain. As shown in FIG. 2, the initial Austenite strain is given by the sum of the three strain coefficients E+A+C, while the final Austenite strain is represented by the coefficient E. The recoverable strain is given by the difference between the Austenite strain and the Martensite (or hard-stop) strain. Thus, the form of the model provides predictions of the steady-state shaken down performance (E), the amount of motion loss (A and C), and the rate at which shakedown occurs (B and D). It was observed that this particular model fitted the empirical data with negligible error.

It is appreciated that knowing these parameters, particularly as functions of the loading conditions allows tradeoffs between performance, and material preparation costs to be made, and the benefits thereof to be incorporated into the overall actuator design and shake-down processes.

Figure 3:
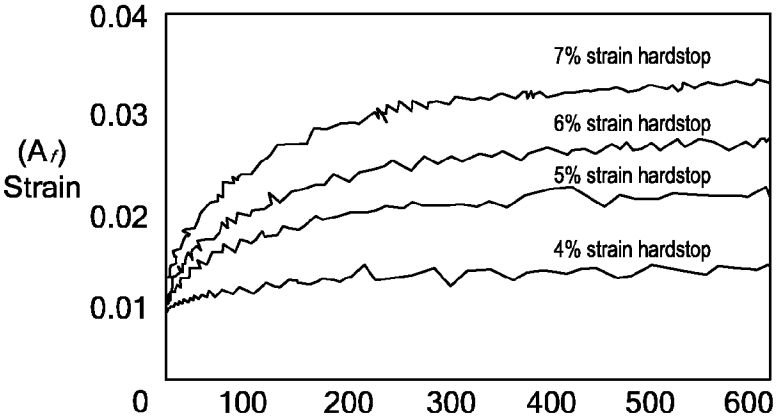
FIG. 3 is a schematic representation of a plurality of Austenitic strain plots showing differing decay rates and final recoverable strains for differing allowable hard-stop strains.
Figure 4:
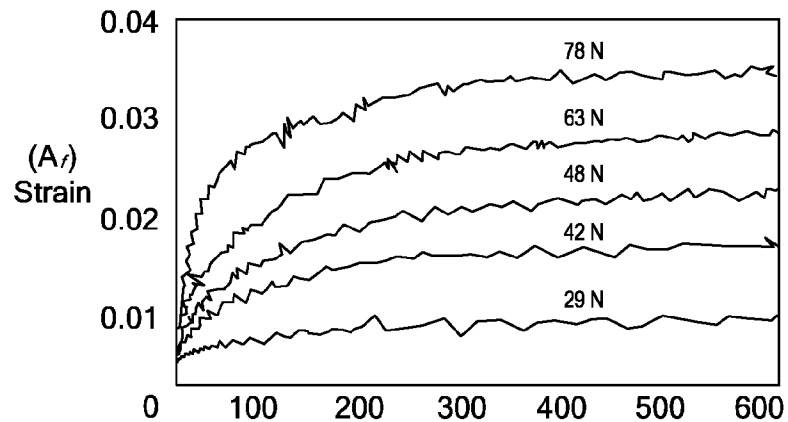
FIG. 4 is a schematic representation of a plurality of Austenitic strain plots showing differing decay rates and final recoverable strains for differing load magnitudes.
Figure 5:
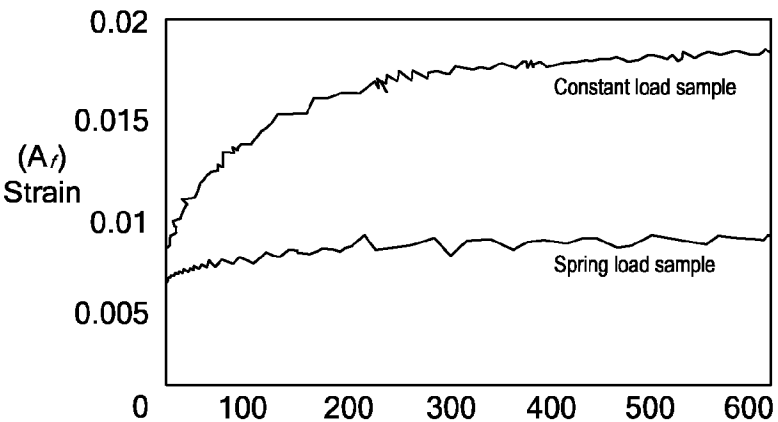
FIG. 5 is a schematic representation of a plurality of Austenitic strain plots showing differing decay rates and final recoverable strains for differing load forms.

Turning to FIGS. 3-5, it is appreciated that variations in loading magnitudes, hard-stop strain positioning, and load forms present measurable affects on the wire strain performance during shakedown. As such, these variables are preferably determined prior to cycling. At an initial step 100 (FIG. 6), for example, the allowable strain during shake-down is determined, based on the wire 12 composition and configuration and the proposed application, and the hard-stop location is set accordingly. As shown in FIG. 3, allowing more strain in the Martensite phase produces more motion between the Austenite and Martensite phases, with the tradeoff being reduced fatigue life. However, it is also appreciated that the shakedown decay constants of the model decrease fairly linearly with increasing allowed hard-stop strain. This trend indicates that shakedown occurs faster at larger levels of strain which can be taken advantage of to reduce material preparation time and cost.

Next, at a step 102 (FIG. 6), the desired load magnitude for shaking down the wire 12 is determined, based again on the proposed application, required final recoverable stroke, and allocated material preparation costs. The load acting on the wire 12 in the apparatus may be varied, for example, by changing the dead weight, by adjusting leverage (or otherwise mechanical advantage), or by adding wires 12 acting in parallel (accordingly, it is also appreciated that the actuating or transforming current must also be varied). Here, it is appreciated that larger loads start with a higher strain (less net motion), and decay to an increasingly greater extent and at a faster pace (FIG. 4). Thus, varying the load during shake-down enables the wire 12 to achieve a variable final recoverable strain at variable cycles, with the primary trade-off being between lost recoverable strain and reaching a stable performance at a reduced number of cycles. Again, with respect to the latter, this saves in material preparation time and cost.

Figure 6:
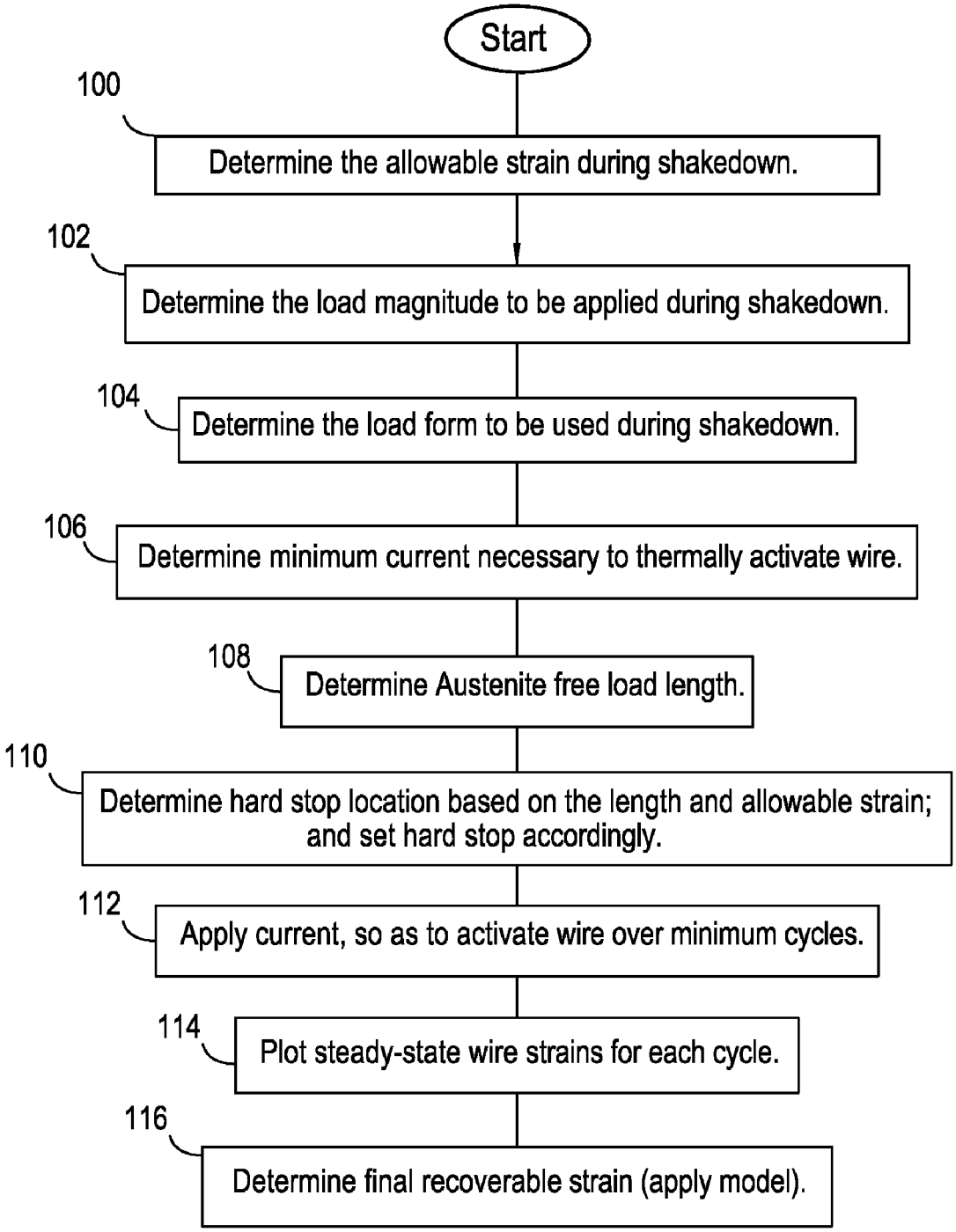
FIG. 6 is a flow diagram of a method of conditioning a shape memory wire, in accordance with a preferred embodiment of the invention.

At a step 104, the appropriate load form to be applied during shakedown is determined (FIG. 6). Here, it is appreciated that various load forms (e.g., constant, spring, etc.) are encountered in the art; for example, it is common for applications to operate against a reset spring, wherein the strain in both the Austenite and Martensite phases is determined by the equilibrium between the SMA material and the spring. In the present invention, a constant load and a spring load bearing a spring stiffness and maximum force congruent to the constant load were plotted and compared (FIG. 5). The spring load presented a substantially different shake-down compared to that of the constant load. As shown, it is appreciated that the spring and constant load shake-downs start at nearly the same Austenite strain (as expected since the loads are initially congruent); but decay at different rates, with the spring load strain being the slower to decay. The spring load shake-down results in a substantial (e.g. 50%) increase in recoverable strain and substantial (e.g., 67%) reduction in lost motion compared to the congruent constant load. Thus, where the proposed application will apply a spring load to a wire actuator, a spring load form should be used in the shake-down of the wire 12. An exception to this rule arises when a constant load can be used during the shake-down process to achieve the same final performance as achieved by the above spring, but with a fewer number of cycles. The inventive model described earlier is used to determine the optimum constant load magnitude in this case.

Figure 1A:
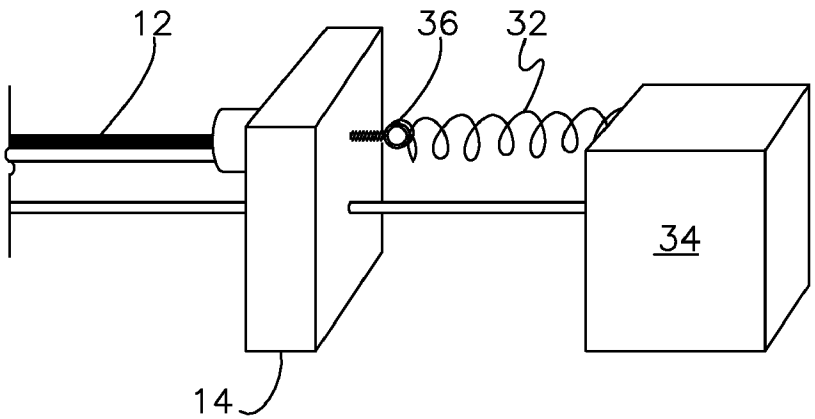
FIG. 1*a* is an elevation of the apparatus shown in FIG. 1, wherein the dead weight has been replaced by a tensioned spring, in accordance with a preferred embodiment of the invention.

To change the load form, the apparatus 10 may be modified, for example, by removing the hard-stop 20 and replacing the dead weight 22 and pulley 26 with a tension spring 32 fixed at one end to the slider 14 and at the other end to a fixed structure 34 via an adjustable length hook (or otherwise adjustment mechanism) 36 (FIG. 1*a*). The hook 36 enables the pre-tension of the spring 32 to be adjusted. The process continues at steps 106 through 116, by determining the minimum current necessary to thermally activate the wire 12; determining the AFL; determining the hard stop location based on the length and allowable strain and setting the hard-stop 20; applying the current, so as to activate the wire over a minimum number of cycles depending upon the allowable error rate; plotting the steady-state Austenitic and Martensitic strains for each cycle; and determining the final recoverable strain when the data stabilizes, for example, by applying a double-exponential model, as previously discussed (FIG. 6).

Finally, it is also within the ambit of the present invention to tailor wire configuration (e.g., by reducing its cross-sectional area, or otherwise introducing a bias or gradient in the temperature or stress field over the wire) and/or its interconnection with the apparatus 10, so as to control and minimize the number of nucleation sites (i.e., points of origination from which violent phase transformation initiates and then propagates through the wire as it undergoes stress-induced Austenitic to Martensitic transformation) during the shake-down process in superelastic SMA wire. It is appreciated that the local damage accumulated at these sites due to very high local stresses occurring during the nucleation events result in reduced local wire capacity. Thus, by controlling the number and location of the nucleation sites (preferably at the ends of the wire 12 (as shown in FIG. 1), and subsequently discarding the affected portions), the fatigue life of the wire 12 is increased.

Ranges disclosed herein are inclusive and combinable (e.g., ranges of "up to about 25 wt %, or, more specifically, about 5 wt % to about 20 wt %", is inclusive of the endpoints and all intermediate values of the ranges of "about 5 wt % to about 25 wt %," etc.). "Combination" is inclusive of blends, mixtures, alloys, reaction products, and the like. Furthermore, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the state value and has the meaning dictated by context, (e.g., includes the degree of error associated with measurement of the particular quantity). The suffix "(s)" as used herein is intended to include both the singular and the plural of the term that it modifies, thereby including one or more of that term (e.g., the colorant(s) includes one or more colorants). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

Suitable algorithms, processing capability, and sensor inputs are well within the skill of those in the art in view of this disclosure. This invention has been described with reference to exemplary embodiments; it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

What is claimed is:

1. A method of conditioning a thermally activated shape memory alloy wire so as to achieve steady state performance in an application, said method comprising:

a). applying a load to, so as to produce tension in, the wire;

b). determining a hard-stop location based on a predetermined Austenite free length, maximum allowable strain, and wire fatigue life, c). setting at least one hard-stop at the location wherein the hard-stop is spaced from the wire and load, and selectively engaging the wire and load, so as to limit strain in and prevent damage to the wire when in the Martensitic phase, or limit strain recovery when the wire transforms back to the Austenitic phase;

d). incrementally increasing an input current and observing the wire, so as to determine a minimum current sufficient to completely transform the wire from a Martensitic phase to an Austenitic phase based on the load, wire type, and wire diameter;

e). repetitively applying the minimum current to the wire over a plurality of cycles, such that the wire heats, so as to fully transform from the Martensitic and to the Austenitic phase, and then cools, so as to fully transform back to the Martensitic phase;

f). plotting a steady-state wire strain when in the Martensitic and Austenitic phases for each cycle; and g). determining a final recoverable Austenitic strain, based on plotting the steady-state wire strain.

2. The method as claimed in claim 1, wherein step a) further includes the steps of selecting a load form based on the application.

3. The method as claimed in claim 1, wherein step d). further includes the steps of externally supporting the load so as to reduce tension in the wire, applying a target current to the wire, removing the external support so as to reproduce tension in the wire, and observing a force-deflection curve of the wire.

4. The method as claimed in claim 1, wherein step g). includes the steps of pre-determining an allowable strain based on the application.

5. The method as claimed in claim 1, wherein step g). includes the steps of fitting a curve to the points using a model, and extrapolating the final recoverable strain.

6. The method as claimed in claim 5, wherein the model employs a double-exponential curve.

7. The method as claimed in claim 6, wherein the model employs an equation in the form:

$$\epsilon=-Ae^{-x/B}-Ce^{-x/D}+E$$

x is the number of cycles,

B and D are decay rate constants with units of cycles, and

A and C describe the amount of strain lost at each decay rate.

8. The method as claimed in claim 1, further comprising:

g. controlling the number and location of nucleation sites within the wire.

9. The method as claimed in claim 1, wherein steps a) through d). further include the steps of iteratively determining an optimum load and hard-stop location using a curve-fit model.

10. The method as claimed in claim 1, wherein step g). includes the steps of fitting a curve to the points, estimating steady state performance parameters, and adjusting or terminating the method based on the estimated parameters, using a model.

* * * * *